US011208835B2

(12) United States Patent
Su

(10) Patent No.: US 11,208,835 B2
(45) Date of Patent: Dec. 28, 2021

(54) ADJUSTING BASE FOR DOOR CLOSER

(71) Applicant: Arctek Industrial Co., Ltd., Beidou Township, Changhua County (TW)

(72) Inventor: Wen-Yuan Su, Shetou Township (TW)

(73) Assignee: Arctek Industrial Co., Ltd., Beidou Township (TW)

( * ) Notice: Subject to any disclaimer, the term of this patent is extended or adjusted under 35 U.S.C. 154(b) by 0 days.

(21) Appl. No.: 16/899,679

(22) Filed: Jun. 12, 2020

(65) Prior Publication Data

US 2021/0025208 A1 Jan. 28, 2021

(30) Foreign Application Priority Data

Jul. 24, 2019 (TW) ..... 108126235

(51) Int. Cl.
*E05F 1/00* (2006.01)
*E05D 7/04* (2006.01)

(52) U.S. Cl.
CPC ..... *E05F 1/00* (2013.01); *E05D 7/0415* (2013.01); *E05Y 2900/132* (2013.01)

(58) Field of Classification Search
CPC ..... E05D 7/04; E05D 7/0415; E05D 7/0423; E05D 7/0446; E05D 7/081; E05D 7/084; E05D 7/086; E05D 7/10; E05D 5/0246; E05D 2007/0484; E05D 11/104; E05D 11/1064; E05F 1/00; E05F 1/1253; E05F 1/1246; E05F 1/129; E05F 3/104; E05F 3/10; E05F 3/20; E05F 3/225; E05F 3/227; E05Y 2201/638; E05Y 2800/268; E05Y 2900/132; E05Y 2600/452; E05Y 2600/41; E05Y 2600/46; Y10T 16/56; Y10T 16/2771; Y10T 16/2774; Y10T 16/304; Y10T 16/552; Y10T 16/534
See application file for complete search history.

(56) References Cited

U.S. PATENT DOCUMENTS 1,668,839 A * 5/1928 Cureton ..... F16C 17/08 384/243
2,184,532 A * 12/1939 Schroeder ..... E05D 7/081 16/236

(Continued)

FOREIGN PATENT DOCUMENTS

CN 203701820 U * 7/2014 ..... E05F 3/104
CN 204299358 U * 4/2015

(Continued)

*Primary Examiner* — Chuck Y Mah
(74) *Attorney, Agent, or Firm* — Karin L. Williams; Alan D. Kamrath; Mayer & Williams PC

(57) ABSTRACT

An adjusting base for door closer includes a fixing member, an adjusting member, and at least one adjusting unit. The fixing member is configured to be fixed to a surface, and an upper surface of the fixing member is arranged with at least one protrusion. The adjusting member is arranged on the upper surface of the fixing member in an adjustable manner, and configured to be connected to a door closer. The adjusting member is formed with at least one adjusting hole for receiving the at least one protrusion. The at least one adjusting unit is movably arranged on the adjusting member and configured to abut against the at least one protrusion to adjust a relative position between the adjusting member and the fixing member.

10 Claims, 6 Drawing Sheets

(56) References Cited

U.S. PATENT DOCUMENTS

| | | | | | |
|---|---|---|---|---|---|
| 3,828,394 | A * | 8/1974 | Horgan, Jr. | E05D 7/081 | 16/241 |
| 4,142,272 | A * | 3/1979 | Oogami | E05D 7/0423 | 16/245 |
| 4,209,946 | A * | 7/1980 | Akai | E05D 7/0423 | 16/245 |
| 4,646,472 | A * | 3/1987 | Sugawara | E05F 1/123 | 16/238 |
| 5,380,095 | A * | 1/1995 | Pryor | E05D 15/0621 | 384/8 |
| 8,528,169 | B1 | 9/2013 | Yu | | |
| 8,578,556 | B1 * | 11/2013 | Yu | E05F 3/104 | 16/53 |
| 9,605,457 | B2 * | 3/2017 | Humble | E05D 7/04 | |
| 10,604,979 | B2 * | 3/2020 | Bacchetti | E05D 7/0415 | |
| 2013/0185896 | A1 * | 7/2013 | Yu | E05F 3/226 | 16/55 |
| 2017/0198507 | A1 * | 7/2017 | Humble | E05D 7/0423 | |

FOREIGN PATENT DOCUMENTS

| | | | | | |
|---|---|---|---|---|---|
| CN | 205778101 | U * | 12/2016 | E05F 3/225 | |
| DE | 4242597 | A1 * | 6/1994 | E05D 15/0626 | |
| DE | 202012011586 | U1 | 5/2013 | | |
| EP | 2682552 | A2 | 1/2014 | | |
| KR | 101458549 | B1 * | 11/2014 | E05F 3/104 | |
| TW | M443052 | U | 12/2012 | | |
| TW | M445063 | U | 1/2013 | | |
| TW | 201807302 | A | 3/2018 | | |
| WO | WO-2015060519 | A1 * | 4/2015 | E05F 3/225 | |
| WO | WO2017199188 | A1 | 11/2017 | | |

* cited by examiner

ADJUSTING BASE FOR DOOR CLOSER

BACKGROUND OF THE INVENTION

1. Field of the Invention

The present invention relates to an adjusting base for a door closer, and more particularly, to an adjusting base for a door closer with improved adjusting mechanism.

2. Description of the Prior Art

A door closer is configured to be combined with a door, in order to drive the door to return to a predetermined closed position after the door is opened. Generally, the door closer is fixed to a surface, such as a floor surface or a surface of a door frame, through a mounting base, so as to pivotally connect the door with the door frame. The door closer may not drive the door to return to the predetermined closed position due to poor installation precision. In order to solve the aforementioned problem, a user must repeatedly adjust a position of the mounting base to re-mount the door closer. However, the user cannot conveniently and efficiently adjust the position of the mounting base of the prior art.

SUMMARY OF THE INVENTION

The present invention provides an adjusting base for a door closer.

The adjusting base for door closer of the present invention includes a fixing member, an adjusting member, and at least one adjusting unit. The fixing member is configured to be fixed to a surface, and an upper surface of the fixing member is arranged with at least one protrusion. The adjusting member is arranged on the upper surface of the fixing member in an adjustable manner, and configured to be connected to a door closer. The adjusting member is formed with at least one adjusting hole for receiving the at least one protrusion. The at least one adjusting unit is movably arranged on the adjusting member and configured to abut against the at least one protrusion to adjust a relative position between the adjusting member and the fixing member.

According to an embodiment of the present invention, the at least one protrusion comprises a first protrusion and a second protrusion. The at least one adjusting hole comprises a first adjusting hole configured to receive the first protrusion, and a second adjusting hole configured to receive the second protrusion. The at least one adjusting unit comprises a plurality of first adjusting units movably arranged on the adjusting member and configured to abut against the first protrusion to adjust a relative position between the first protrusion and the first adjusting hole; and a plurality of second adjusting units movably arranged on the adjusting member and configured to abut against the second protrusion to adjust a relative position between the second protrusion and the second adjusting hole.

According to an embodiment of the present invention, at least one of the first adjusting units is movable relative to the adjusting member along a first direction. At least another one of the first adjusting units is movable relative to the adjusting member along a second direction. At least one of the second adjusting units is movable relative to the adjusting member along a third direction. At least another one of the second adjusting units is movable relative to the adjusting member along a fourth direction. The first direction is different from the second direction, and the third direction is different from the fourth direction.

According to an embodiment of the present invention, at first direction is identical to the third direction, and the second direction is identical to the fourth direction.

According to an embodiment of the present invention, at least two of the first adjusting units are movable relative to the adjusting member along the first direction and respectively located at two opposite sides of the first protrusion. At least two of the second adjusting units are movable relative to the adjusting member along the third direction and respectively located at two opposite sides of the second protrusion.

According to an embodiment of the present invention, the adjusting base further comprises a stopping block arranged on the fixing member. The stopping block is configured to abut against the second adjusting unit when the second adjusting unit is moved away from the second protrusion.

According to an embodiment of the present invention, the stopping block is formed with a through hole facing a rotational axis of the second adjusting unit.

According to an embodiment of the present invention, the adjusting member is formed with a plurality of first through holes communicated with the first adjusting hole and configured to receive the plurality of first adjusting units, and a plurality of second through holes communicated with the second adjusting hole and configured to receive the plurality of second adjusting units.

According to an embodiment of the present invention, the first adjusting unit and the first through hole have corresponding thread structures, and the second adjusting unit and the second through hole have corresponding thread structures.

According to an embodiment of the present invention, the adjusting member is formed with a shaft hole configured to be combined with a rotating shaft of the door closer.

According to an embodiment of the present invention, the first adjusting hole and the second adjusting are respectively located at two opposite sides of the shaft hole.

According to an embodiment of the present invention, a moving direction of the at least one adjusting unit relative to the adjusting member is opposite to a moving direction of the adjusting member relative to the fixing member.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
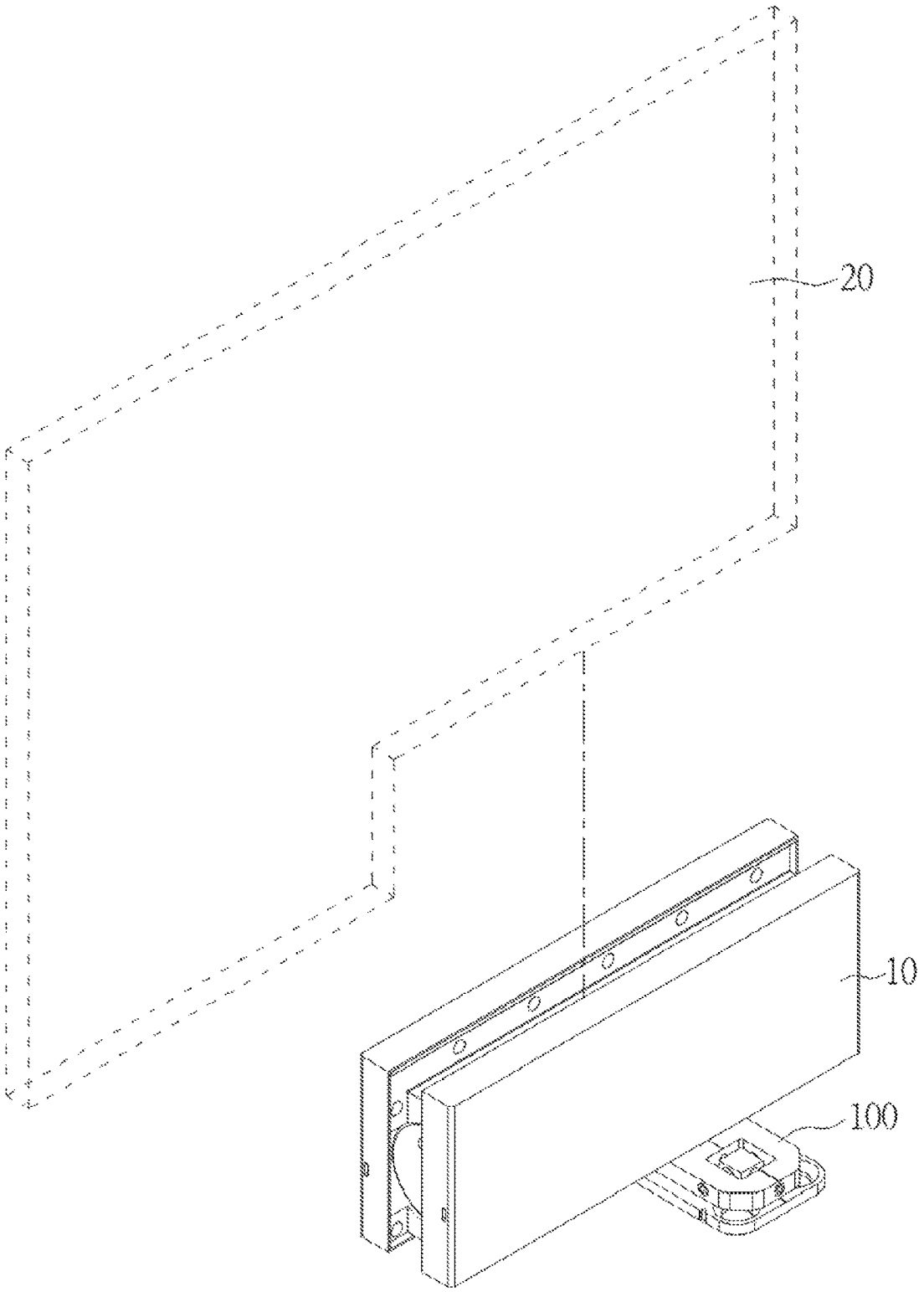
FIG. 1 is a diagram showing a combination of an adjusting base and a door closer according to a first embodiment of the present invention.
Figure 2:
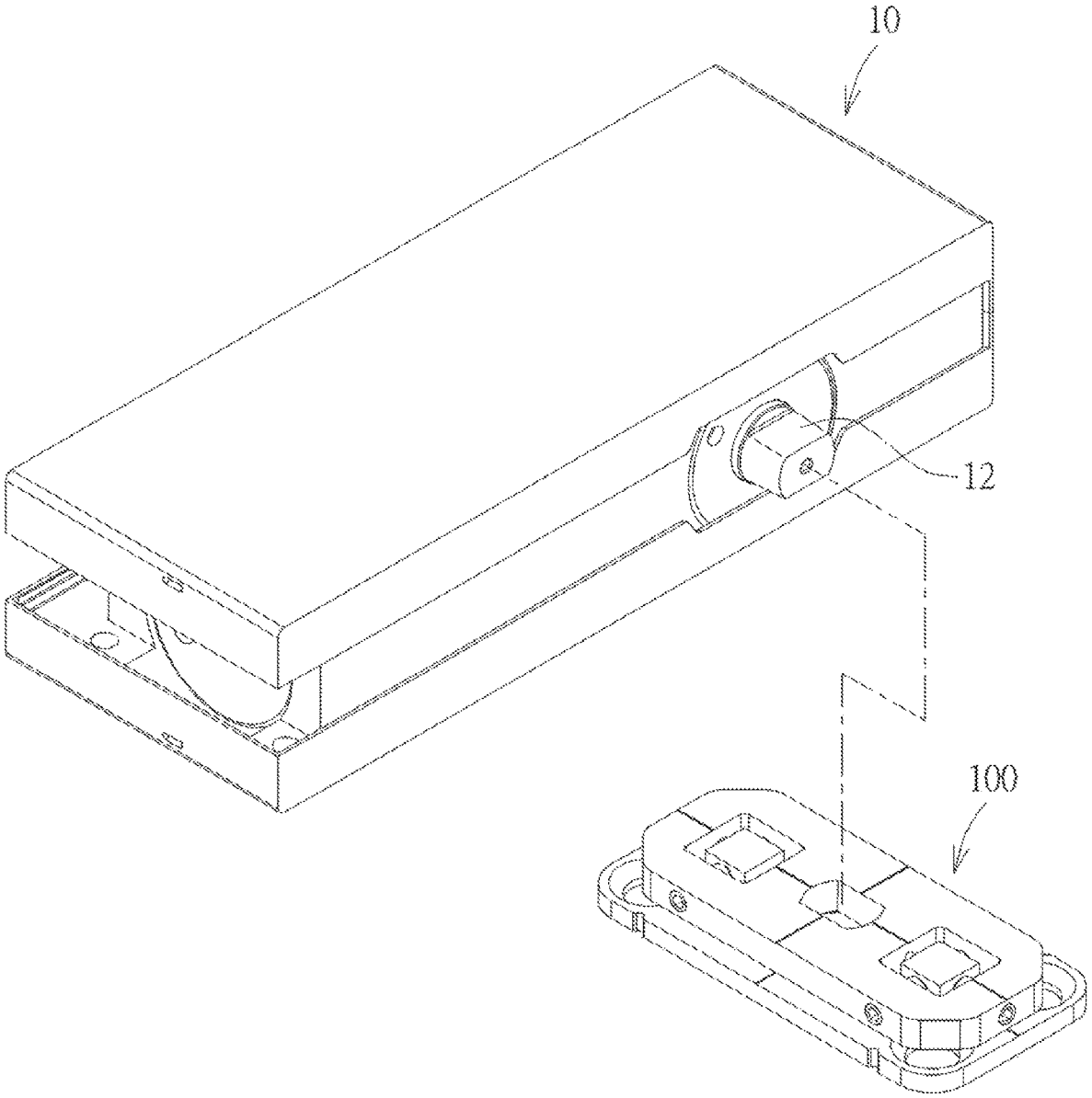
FIG. 2 is an exploded view of the adjusting base and the door closer according to the first embodiment of the present invention.

Please refer to FIG. 1 and FIG. 2. FIG. 1 is a diagram showing a combination of an adjusting base and a door closer according to a first embodiment of the present invention. FIG. 2 is an exploded view of the adjusting base and the door closer according to the first embodiment of the present invention. As shown in figures, an adjusting base 100 of the first embodiment of the present invention is configured to be combined with a door closer 10. For example, the door closer 10 has a rotating shaft 12 configured to be inserted into a shaft hole 122 of the adjusting base 100, but the present invention is not limited thereto. The door closer 10 is configured to be combined with a door 20, such that the door 20 is pivoted relative to a door frame (not shown in figures). When the door 20 is opened, a returning mechanism inside the door closer 10 is configured to drive the door 20 to return to a predetermined closed position.

Figure 3:
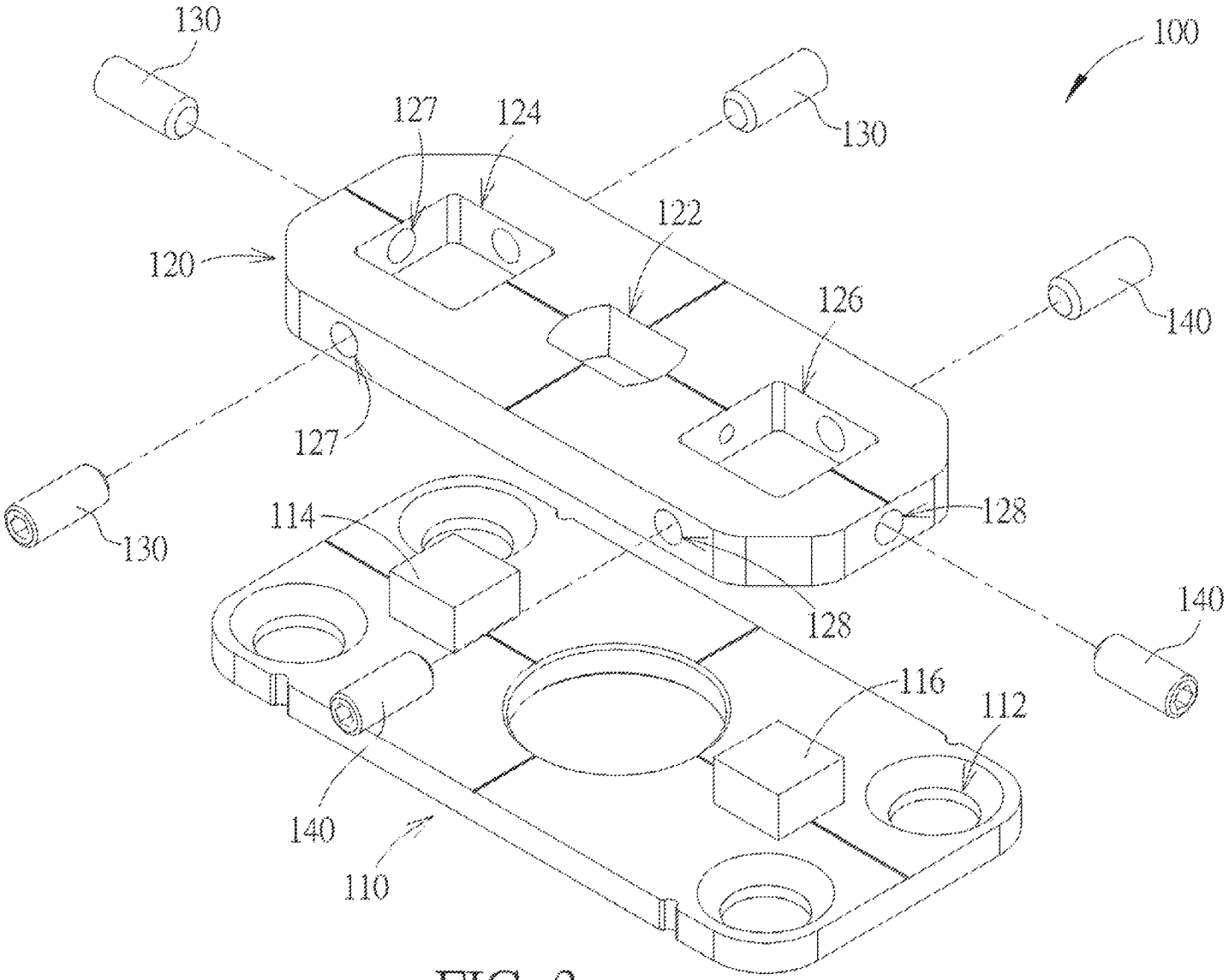
FIG. 3 is an exploded view of the adjusting base according to the first embodiment of the present invention.

Please refer to FIG. 3. FIG. 3 is an exploded view of the adjusting base according to the first embodiment of the present invention. As shown in FIG. 3, the adjusting base 100 of the first embodiment of the present invention comprises a fixing member 110, an adjusting member 120, a plurality of first adjusting units 130 and a plurality of second adjusting units 140. The fixing member 110 is configured to be fixed to a surface, such as a floor surface or a surface of a door frame. For example, the fixing member 110 is formed with fixing holes 112 configured to allow fixing units (not shown in the figure) to pass through to fix the fixing member 110 to a specific surface. In addition, an upper surface of the fixing member 110 is arranged with a first protrusion 114 and a second protrusion 116. The adjusting member 120 is arranged on the upper surface of the fixing member 110 in an adjustable manner. The adjusting member 120 is formed with a shaft hole 122, a first adjusting hole 124 and a second adjusting hole 126. The shaft hole 122 is configured to be combined with the rotating shaft 12 of the door closer 10. The first adjusting hole 124 is configured to receive the first protrusion 114. The second adjusting hole 126 is configured to receive the second protrusion 116. The first adjusting hole 124, the first protrusion 114, the second adjusting hole 126 and the second protrusion 116 are configured to define a movable range of the adjusting member 120 relative to the fixing member 110. In the present embodiment, the first adjusting hole 124 and the second adjusting hole 126 are respectively located at two opposite sides of the shaft hole 122, but the present invention is not limited thereto.

In addition, the adjusting member 120 is further formed with a plurality of first through holes 127 and a plurality of second through holes 128. The first through hole 127 is communicated with the first adjusting hole 124 and configured to receive the first adjusting unit 130. The second through hole 128 is communicated with the second adjusting hole 126 and configured to receive the second adjusting unit 140. The first adjusting unit 130 is movable relative to the adjusting member 120 along the first through hole 127, and the second adjusting unit 140 is movable relative to the adjusting member 120 along the second through hole 128. The first adjusting unit 130 and the first through hole 127 are configured to have corresponding thread structures, and the second adjusting unit 140 and the second through hole 128 are configured to have corresponding thread structures, but the present invention is not limited thereto. The plurality of first adjusting units 130 are configured to abut against the first protrusion 114 to adjust a relative position between the first protrusion 114 and the first adjusting hole 124. The plurality of second adjusting units 140 are configured to abut against the second protrusion 116 to adjust a relative position between the second protrusion 1116 and the second adjusting hole 126.

Figure 4:
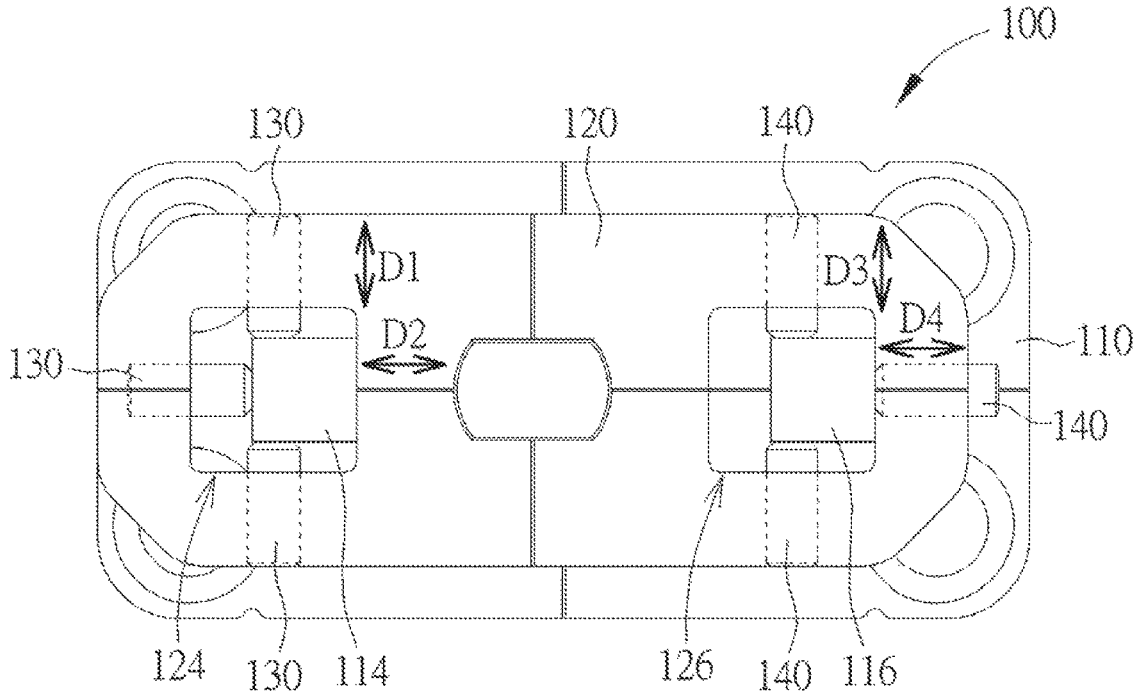
FIG. 4 is a diagram showing the adjusting members of the adjusting base being adjusted to a state according to the first embodiment of the present invention.

Please refer to FIG. 4, and refer to FIG. 3 as well. FIG. 4 is a diagram showing the adjusting member of the adjusting base being adjusted to a state according to the first embodiment of the present invention. As shown in figures, the first adjusting units 130 located at upper and lower sides of the first protrusion 114 are movable relative to the adjusting member 120 along a first direction D1, and the first adjusting unit 130 located at a left side of the first protrusion 114 is movable relative to the adjusting member 120 along a second direction D2. The first direction D1 is different from the second direction D2. In addition, the second adjusting units 140 located at upper and lower sides of the second protrusion 116 are movable relative to the adjusting member 120 along a third direction D3, and the second adjusting unit 140 located at a right side of the second protrusion 116 is movable relative to the adjusting member 120 along a fourth direction D4. The third direction D3 is different from the fourth direction D4. Therefore, the relative position between the first protrusion 114 and the first adjusting hole 124 and the relative position between the second protrusion 116 and the second adjusting hole 126 can be adjusted, so as to adjust a relative position between the fixing member 110 and the adjusting member 120. In the present embodiment, the first direction D1 is identical to the third direction D3, and the second direction D2 is identical to the fourth direction D4, but the present invention is not limited thereto. In addition, in the present embodiment, the first direction D1 and the third direction D3 are parallel to a transverse axis of the adjusting member 120, and the second direction D2 and the fourth direction D4 are parallel to a longitudinal axis of the adjusting member 120, but the present invention is not limited thereto. Moreover, a moving direction of the adjusting unit 130, 140 relative to the adjusting member 120 is opposite to a moving direction of the adjusting member 120 relative to the fixing member 110. For example, when the first adjusting unit 130 at the left side of the first protrusion 114 is moved right relative to the adjusting member 120, the adjusting member 120 is moved left relative to the fixing member 110.

Figure 5:
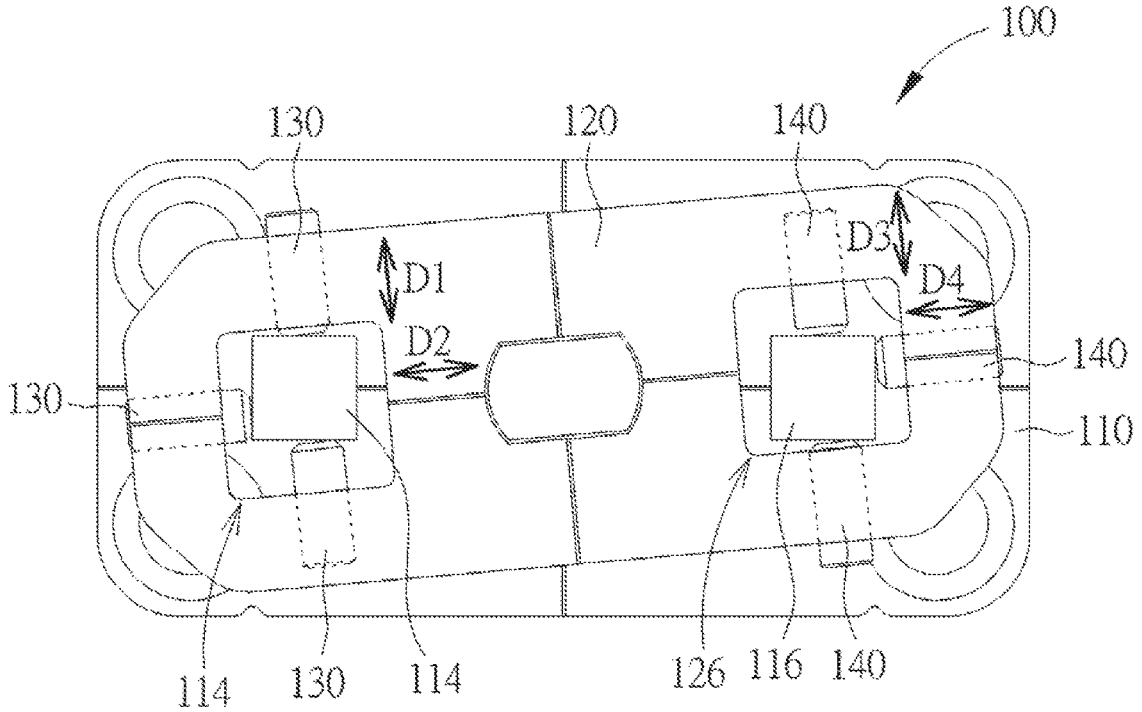
FIG. 5 is a diagram showing the listing members of the adjusting base being adjusted to another state according to the first embodiment of the present invention.

Please refer to FIG. 5, and refer to FIG. 3 as well. FIG. 5 is a diagram showing the adjusting member of the adjusting base being adjusted to another state according to the first embodiment of the present invention. As shown in figures, a user can also use the first adjusting units 130 and the second adjusting units 140 to adjust the relative position between the first protrusion 114 and the first adjusting hole 124 and the relative position between the second protrusion 116 and the second adjusting hole 126, so as to adjust a relative angle between the fixing member 110 and the adjusting member 120.

According to the aforementioned arrangement, when the door closer 10 cannot drive the door 20 to return to the predetermined closed position due to poor installation precision (or other reasons), the user can use the first adjusting units 130 and the second adjusting units 140 to adjust the relative position and the relative angle between the fixing member 110 and the adjusting member 120, such that the door closer 10 can drive the door 20 to return to the predetermined closed position.

Figure 6:
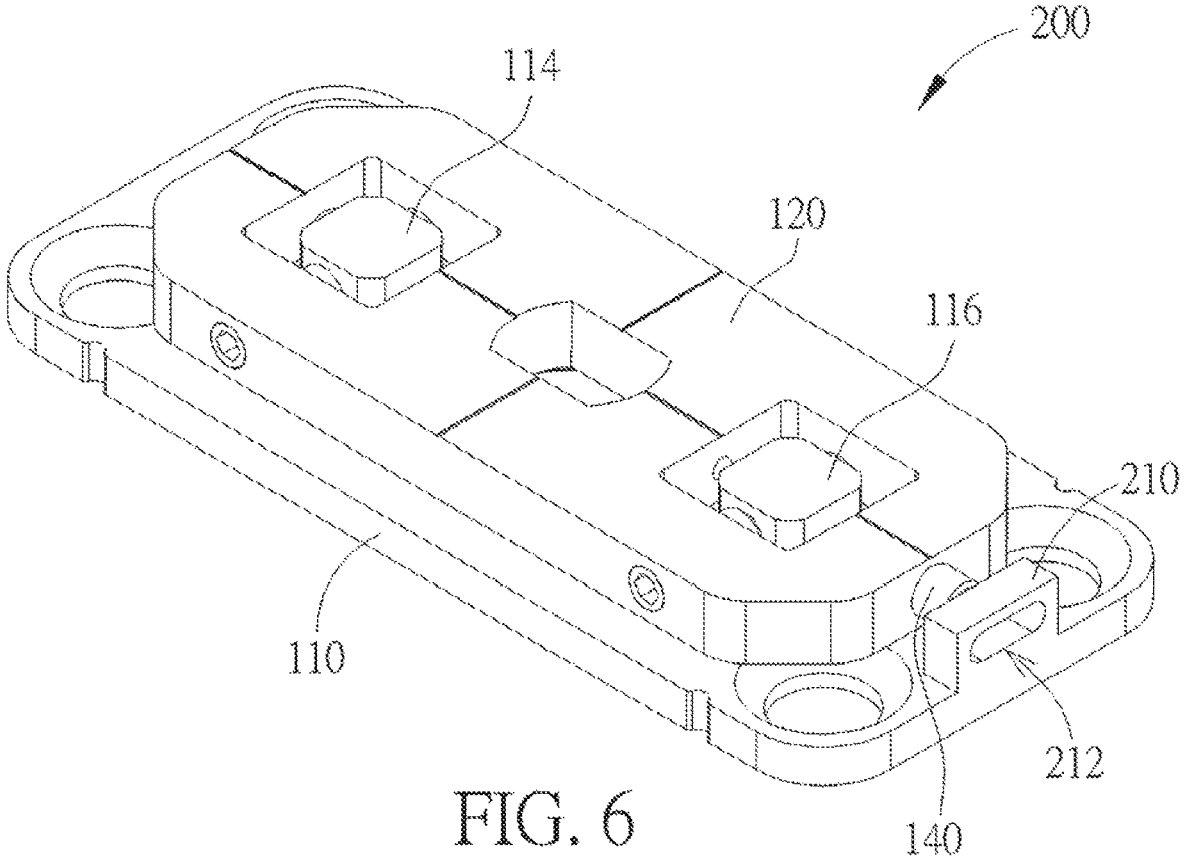
FIG. 6 is a diagram showing an adjusting base according to a second embodiment of the present invention.
Figure 7:
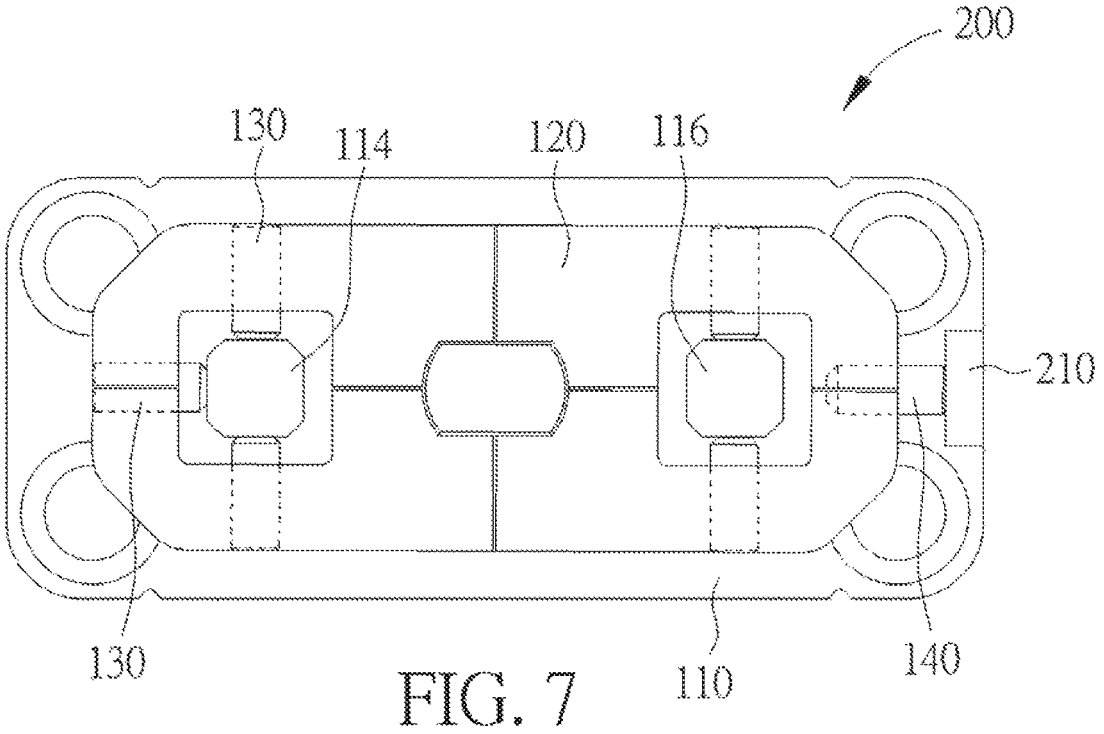
FIG. 7 is a top view of the adjusting base according to the second embodiment of the present invention.

Please refer to FIG. 6 and FIG. 7. FIG. 6 is a diagram showing an adjusting base according to a second embodiment of the present invention. FIG. 7 is a top view of the adjusting base according to the second embodiment of the present invention. As shown in figures, an adjusting base 200 of the second embodiment of the present invention further comprises a stopping block 210 arranged on the fixing member 110. The stopping block 210 is formed with a through hole 212 facing a rotational axis of the second adjusting unit 140 at the right side of the second protrusion 116, in order to allow the user to easily move the second adjusting unit 140 at the right side of the second protrusion 116. The stopping block 210 is configured to abut against the second adjusting unit 140 when the second adjusting unit 140 at the right side of the second protrusion 116 is moved away from the second protrusion 116. As such, the stopping block 210 can allow the user to adjust the relative position between the fixing member 110 and the adjusting member 120 more easily. For example, when a left side of the adjusting base 200 is closer to the door frame, the user may not easily use the first adjusting unit 130 at the left side of the first protrusion 114 to drive the adjusting member 120 to move left relative to the fixing member 110 due to narrow space. Thus, the user can move the second adjusting unit 140 at the right side of the second protrusion 116 away from the second protrusion 116 to abut against the stopping block 210. When the second adjusting unit 140 at the right side of the second protrusion 116 is further moved away from the second protrusion 116, the adjusting member 120 is driven to move left relative to the fixing member 110. Therefore, the user can have enough space to use the second adjusting unit 140 to drive the adjusting member 120 to move left relative to the fixing member 110. In the present invention, the number of the stopping block 210 is not limited to the aforementioned embodiment. Moreover, the stopping block 210 can be arranged at different positions according to design requirements, in order to interact with the second adjusting unit 140 or the first adjusting unit 130.

Figure 8:
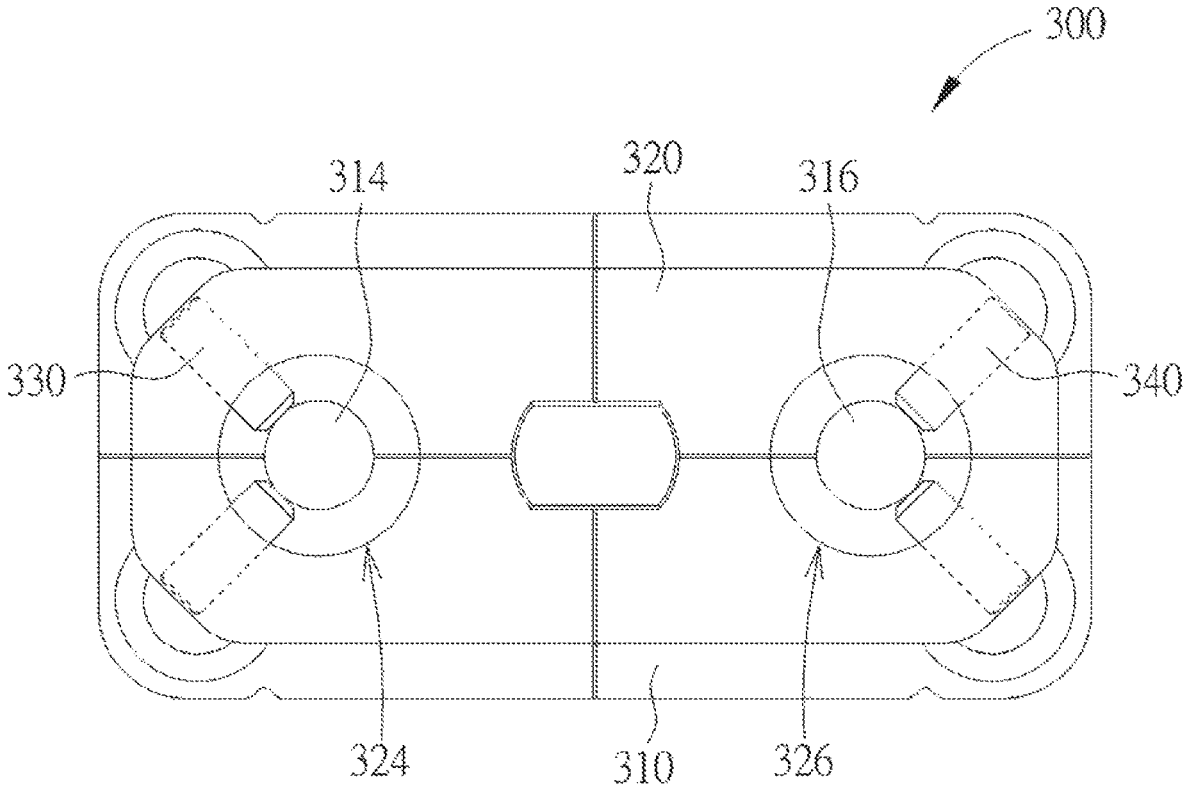
FIG. 8 is a diagram showing an adjusting base according to a third embodiment of the present invention.

Please refer to FIG. 8. FIG. 8 is a diagram showing an adjusting base according to a third embodiment of the present invention. As shown in FIG. 8, an adjusting base 300 of the third embodiment of the present invention comprises two first adjusting units 330 arranged at a left side of a first protrusion 314, and two second adjusting units 340 arranged at a right side of a second protrusion 316. The two first adjusting units 330 are movable in different directions, and the two second adjusting units 340 are movable in different directions. In the present embodiment, the first adjusting unit 330 at a left-upper side of the first protrusion 314 and the second adjusting unit 340 at a right-lower side of the second protrusion 316 are movable in a same direction, and the first adjusting unit 330 at a left-lower side of the first protrusion 314 and the second adjusting unit 340 at a right-upper side of the second protrusion 316 are movable in a same direction, but the present invention is not limited thereto. The first adjusting units 330 and the second adjusting units 340 are respectively located at four corners of the adjusting member 320. When one side of the adjusting base 300 is closer to the door frame, the user can have enough space to move the first adjusting units 330 and the second adjusting units 340, in order to further adjust the relative position and the relative angle between the fixing member 310 and the adjusting member 320.

On the other hand, the number of the first adjusting units 130, 330 and the number of the second adjusting units 140, 340 are not limited to the aforementioned embodiments. The first adjusting units 130, 330 and the second adjusting units 140, 340 can be arranged at different positions according to design requirements. Moreover, shapes of the first protrusions 114, 314, the second protrusions 116, 316, the first adjusting holes 124, 324 and the second adjusting holes 126, 326 are not limited to the aforementioned embodiments. The shapes of the first protrusions 114, 314, the second protrusions 116, 316, the first adjusting holes 124, 324 and the second adjusting holes 126, 326 can be changed according to design requirements. In the present invention, the fixing member is arranged with at least one protrusion, the adjusting member is formed with at least one adjusting hole, and the adjusting base comprises at least one adjusting unit.

In contrast to the prior art, the adjusting base of the present invention can adjust the relative position between the protrusion of the fixing member and the adjusting hole of the adjusting member through the adjusting units, in order to allow the user to easily adjust the relative position and the relative angle between the fixing member and the adjusting member, so as to further improve mounting efficiency of the door closer.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An adjusting base for door closer, comprising:

a fixing member configured to be fixed to a surface, wherein an upper surface of the fixing member is arranged with at least one protrusion;

an adjusting member arranged on the upper surface of the fixing member in an adjustable manner, and configured to be connected to a door closer, wherein the adjusting member is formed with at least one adjusting hole for receiving the at least one protrusion; and at least one adjusting unit movably arranged on the adjusting member and configured to abut against the at least one protrusion to adjust a relative position between the adjusting member and the fixing member;

wherein the at least one protrusion comprises a first protrusion and a second protrusion, the at least one adjusting hole comprises a first adjusting hole configured to receive the first protrusion and a second adjusting hole configured to receive the second protrusion;

wherein the at least one adjusting unit comprises a plurality of first adjusting units movably arranged on the adjusting member and configured to abut against the first protrusion to adjust a relative position between the first protrusion and the first adjusting hole, and a plurality of second adjusting units movably arranged on the adjusting member and configured to abut against the second protrusion to adjust a relative position between the second protrusion and the second adjusting hole;

wherein the adjusting base further comprises a stopping block arranged on the fixing member; wherein the stopping block is configured to abut against the second adjusting unit adjacent to the stopping block when the second adjusting unit adjacent to the stopping block is moved away from the second protrusion.

2. The adjusting base for door closer of claim 1, wherein at least one of the first adjusting units is movable relative to the adjusting member along a first direction, at least another one of the first adjusting units is movable relative to the adjusting member along a second direction, at least one of the second adjusting units is movable relative to the adjusting member along a third direction, and at least another one of the second adjusting units is movable relative to the adjusting member along a fourth direction; wherein the first direction is different from the second direction, and the third direction is different from the fourth direction.

3. The adjusting base for door closer of claim 2, wherein the first direction is identical to the third direction, and the second direction is identical to the fourth direction.

4. The adjusting base for door closer of claim 2, wherein at least two of the first adjusting units are movable relative to the adjusting member along the first direction and respectively located at two opposite sides of the first protrusion; wherein at least two of the second adjusting units are movable relative to the adjusting member along the third direction and respectively located at two opposite sides of the second protrusion.

5. The adjusting base for door closer of claim 1, wherein the stopping block is formed with a through hole facing a rotational axis of the second adjusting unit.

6. The adjusting base for door closer of claim 1, wherein the adjusting member is formed with a plurality of first through holes communicated with the first adjusting hole and configured to receive the plurality of first adjusting units, and a plurality of second through holes communicated with the second adjusting hole and configured to receive the plurality of second adjusting units.

7. The adjusting base for door closer of claim 6, wherein each of the first adjusting units and the corresponding first through hole have corresponding thread structures, and each of the second adjusting units and the corresponding second through hole have corresponding thread structures.

8. The adjusting base for door closer of claim 1, wherein the adjusting member is formed with a shaft hole configured to be combined with a rotating shaft of the door closer.

9. The adjusting base for door closer of claim 1, wherein the adjusting member is formed with a shaft hole configured to be combined with a rotating shaft of the door closer, and the first adjusting hole and the second adjusting hole are respectively located at two opposite sides of the shaft hole.

10. The adjusting base for door closer of claim 1, wherein a moving direction of the at least one adjusting unit relative to the adjusting member is opposite to a moving direction of the adjusting member relative to the fixing member.

* * * * *